US008156846B2

(12) United States Patent
Chi

(10) Patent No.: US 8,156,846 B2
(45) Date of Patent: Apr. 17, 2012

(54) RELEASE DEVICE OF EXTENSION ROD ASSEMBLY

(76) Inventor: Yuan-Chin Chi, Ta-Li (TW)

( * ) Notice: Subject to any disclaimer, the term of this patent is extended or adjusted under 35 U.S.C. 154(b) by 362 days.

(21) Appl. No.: 12/609,784

(22) Filed: Oct. 30, 2009

(65) Prior Publication Data

US 2011/0100168 A1 May 5, 2011

(51) Int. Cl.
*B25B 23/16* (2006.01)

(52) U.S. Cl. ..... 81/177.85

(58) Field of Classification Search ..... 81/177.85, 81/177.1

See application file for complete search history.

(56) References Cited

U.S. PATENT DOCUMENTS

| | | | | |
|---|---|---|---|---|
| 6,267,032 | B1 * | 7/2001 | Hsieh | 81/177.85 |
| 7,013,766 | B2 * | 3/2006 | Lee | 81/177.85 |
| 7,401,538 | B2 * | 7/2008 | Cheng | 81/177.9 |
| 2002/0162426 | A1 * | 11/2002 | Lee | 81/177.85 |

* cited by examiner

*Primary Examiner* — David B Thomas

(57) ABSTRACT

An extension rod includes a body having an axial passage and a restriction hole and a positioning hole are respectively defined radially in the body and communicate with the axial passage. A shaft of a control member is rotatably inserted into the positioning hole and includes a recess defined in radially which is located within the axial passage. An operation rod is axially movably inserted into the axial passage and a spring is biased between the operation rod and an end piece which seals the axial passage. The operation rod is engaged with the recess and includes first and second dents in different depths. When rotating the shaft, the first and second dents are movable to receive a bead in the restriction hole such that the bead is control to protrude out from the restriction hole to position or release a socket mounted to the body.

8 Claims, 6 Drawing Sheets

RELEASE DEVICE OF EXTENSION ROD ASSEMBLY

FIELD OF THE INVENTION

The present invention relates to an extension rod assembly, and more particularly, to a release device of an extension rod assembly so as to secure or release a socket to or from the body of the extension rod assembly.

BACKGROUND OF THE INVENTION

A conventional extension rod assembly is shown in FIGS. 1 to 3, and generally includes a body 1' having a sleeve 2' mounted thereto which is rotatable about the axis of the body 1' to control a rod 3' within the body 1'. The body 1' includes an axial passage 10' in which the rod 3' is received, a positioning hole 11', a radial groove 12' and a radial restriction hole 13', wherein the axial passage 10' communicates with the groove 12' and the restriction hole 13'. The rod 3' includes a through hole 30' which is located corresponding to the groove 12', and a guide recess 31' which is located corresponding to the restriction hole 13'. A pin 40' is inserted into a limitation hole 23' of the sleeve 2', the groove 12' of the body 1' and the through hole 30' of the rod 3'. A bead 41' is located in the restriction hole 13' of the body 1' and received in the guide recess 31' of the rod 3'. A spring 15' and a ball 16' are received in the positioning hole 11' of the body 1', the ball 16' is pushed by the spring 15' and contacts one of two index holes 20', 21' of the sleeve 2' so as to position the sleeve 2'. When rotating the sleeve 2' about the axis of the body 1', the pin 40' is moved within the groove 12' and the ball 16' is pushed inward by the sleeve 2' to compress the spring 15' as shown in FIG. 2 and the rod 3' is rotated by the pin 40'. The ball 16' is engaged with the other index hole 21' to position the sleeve 2' at the second position. In the meanwhile, the guide recess 31' of the rod 3' is rotated such that the bead 41' is completely accommodated in the guide recess 31' and does not protrude from the surface of the body 1' via the restriction hole 13' as shown in FIG. 3. In this status, a socket (not shown) can be easily mounted to the body 1' or removed from the body 1' because the bead 41' is merged into the restriction hole 13'. On the contrary, when the sleeve 2' is rotated to its first position where the bead 41' partially protrudes out from the rod 3' via the restriction hole 13' and contacts against the inner periphery of the socket to position the socket.

However, the body 1' and the sleeve 2' each have many positions to be machined to have holes and grooves, and this means a high manufacturing cost is involved. In addition, there are many parts involved which require significant assembling time.

The present invention intends to provide an extension rod assembly with a release device which includes less number of parts and can be manufactured at low cost.

SUMMARY OF THE INVENTION

The present invention relates to an extension rod assembly which comprises a body having an axial passage defined in the first end of the body and a restriction hole is defined radially in the body. An end piece seals the axial passage at the first end of the body. A recessed area is defined in an outer periphery of the body and a positioning hole is defined in the recessed area. Both of the restriction hole and the positioning hole communicate with the axial passage.

A control member includes a handle and a shaft which is rotatably inserted into the positioning hole and the handle is rotatably engaged with the recessed area. The control member is rotatable about an axis thereof and the shaft includes a recess which is located within the axial passage. An eccentric part is formed and defines the recess.

An operation rod is axially and movably inserted into the axial passage from the first end of the body and a spring is biased between a first end of the operation rod and the end piece. The operation rod includes a first dent and a second dent which communicates with the first dent and deeper than the first dent in radial direction. The first and second dents are movable to be in alignment with the restriction hole. A second end of the operation rod is engaged with the recess in the shaft.

A bead is movably engaged with the restriction hole and the second end of the operation rod is driven axially by the eccentric part when rotating the shaft so that the bead partially protrudes out from the restriction hole when the bead is engaged with the first dent. The bead is merged into the restriction hole when the bead is engaged with the second dent.

The primary object of the present invention is to provide a quick release device for extension rod assembly, wherein the number of parts required is less than the conventional ones.

Another object of the present invention is to provide a quick release device for extension rod assembly, wherein the structure of the assembly is simple and can be manufactured at low cost.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
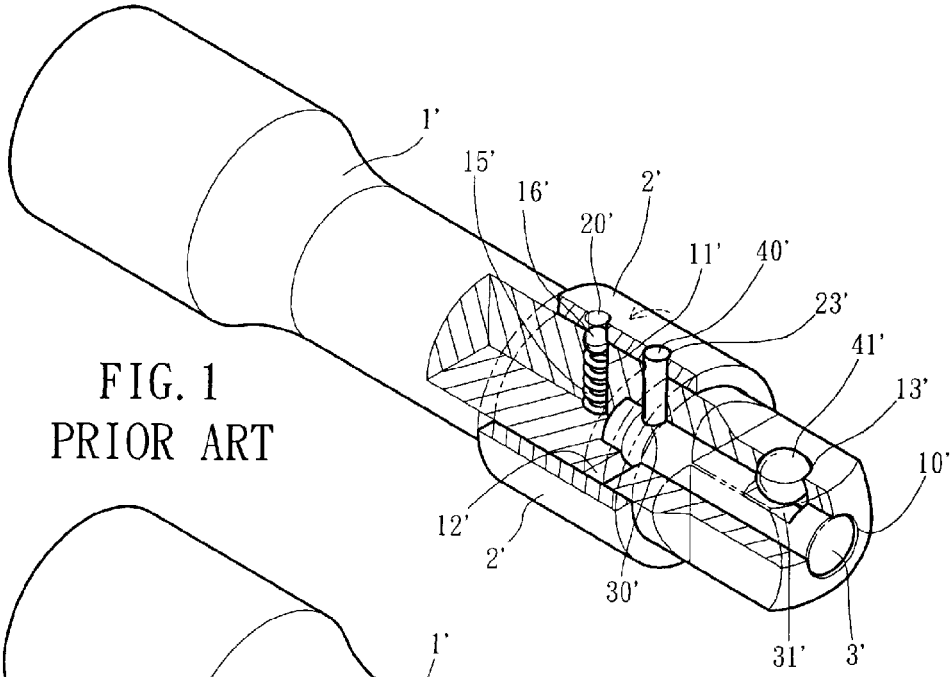
FIG. 1 PRIOR ART
FIG. 1 is a partial cross sectional view showing the conventional release device of extension rod assembly.
Figure 2:
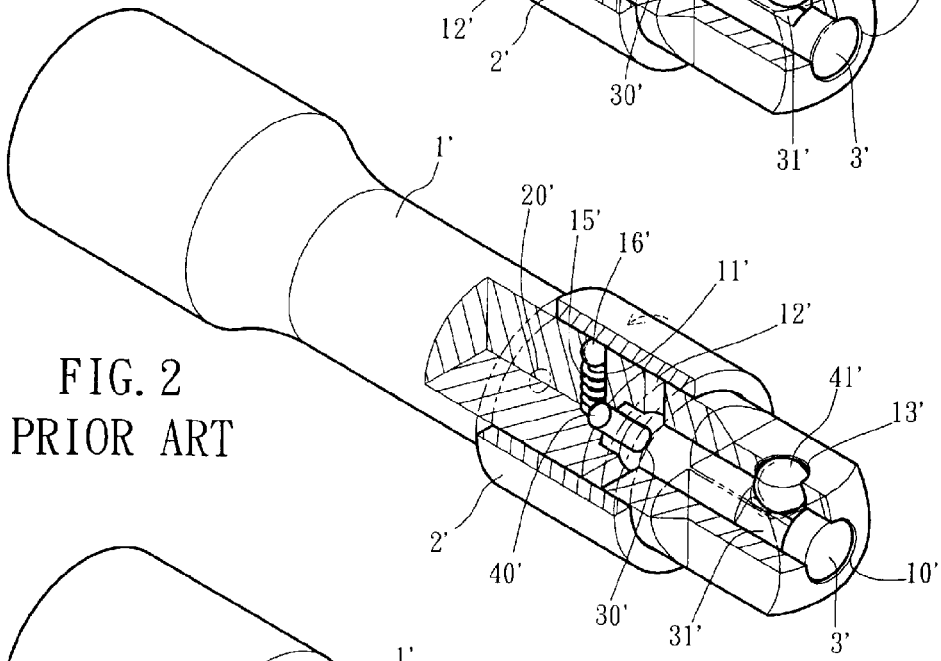
FIG. 2 PRIOR ART
FIG. 2 is a partial cross sectional view to show that the sleeve and the rod are rotated and the bead begins to merge into the body.
Figure 3:
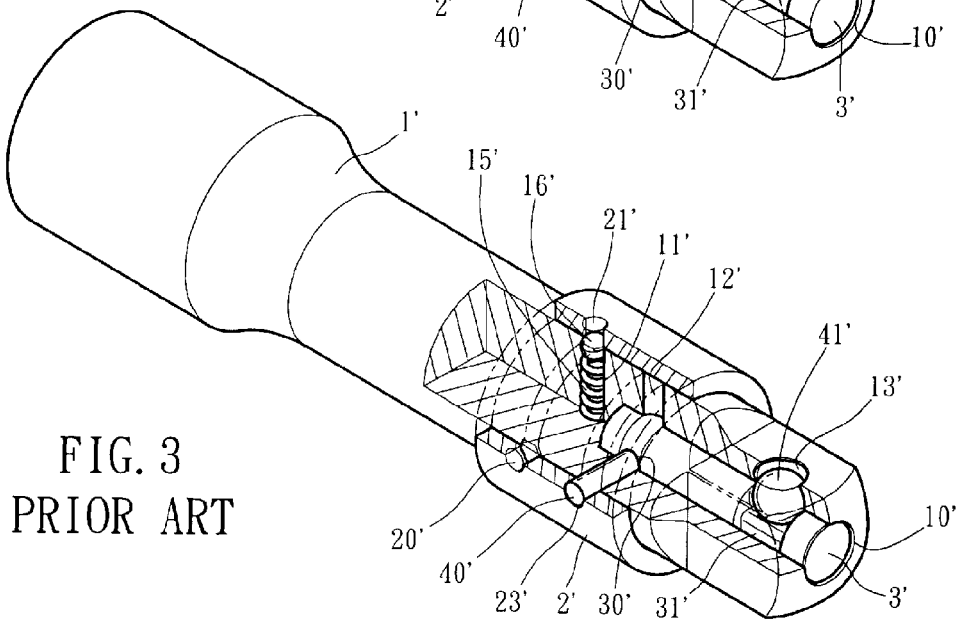
FIG. 3 PRIOR ART
FIG. 3 is a partial cross sectional view to show that the sleeve is positioned at the second position and the bead is merged into the body.
Figure 4:
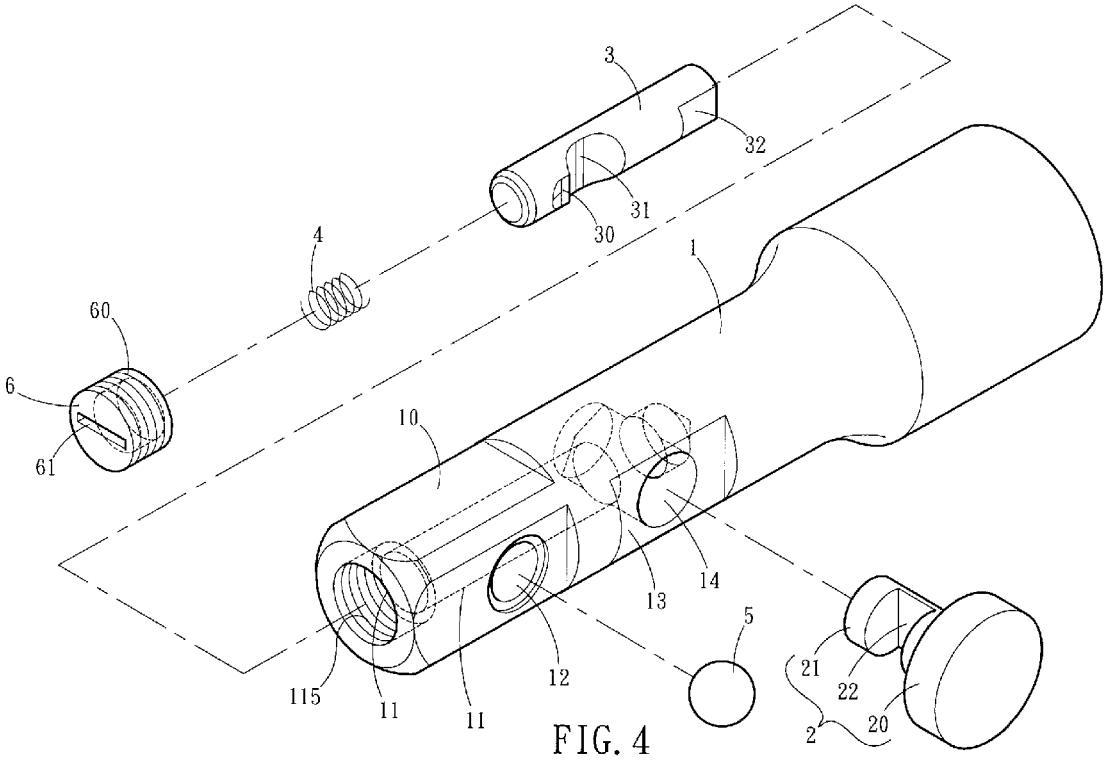
FIG. 4 is an exploded view to show the release device of extension rod assembly of the present invention.
Figure 5:
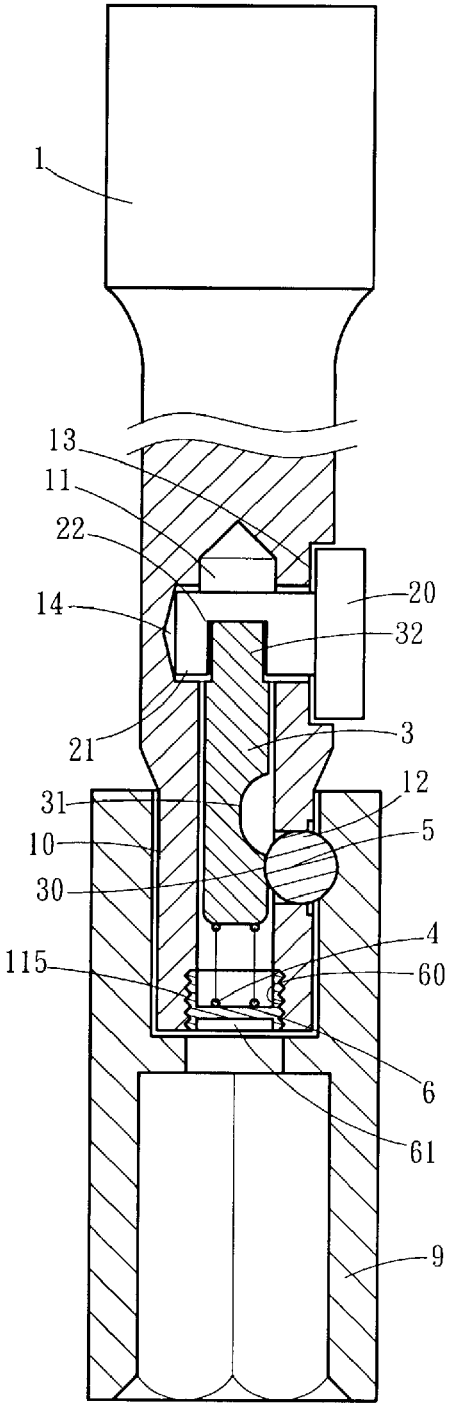
FIG. 5 is a partial cross sectional view to show that a socket is connected to the body of the extension rod assembly and the control member is not yet rotated.
Figure 6:
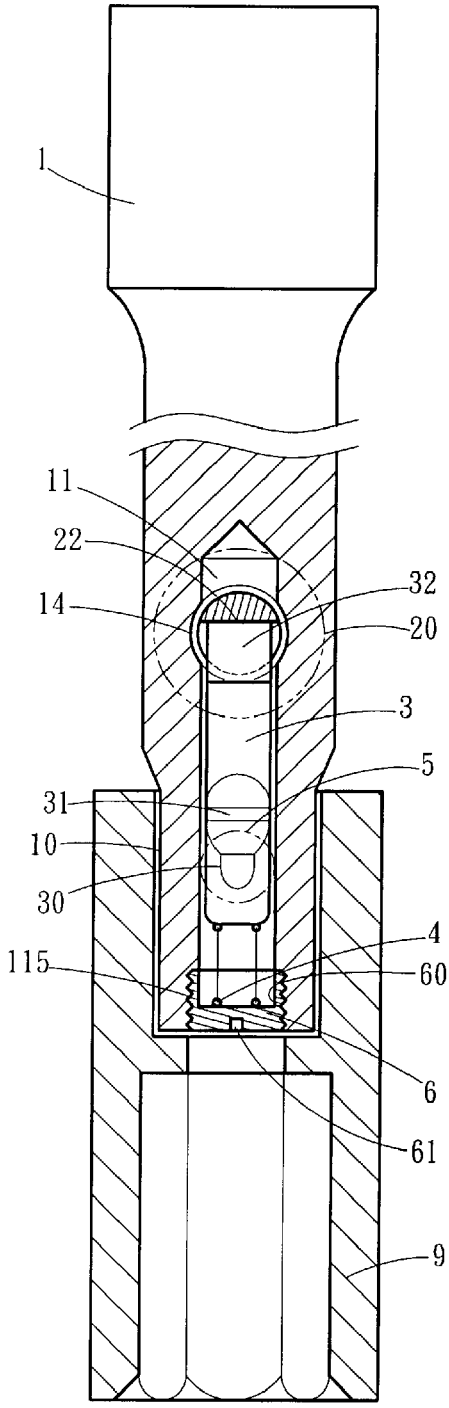
FIG. 6 shows a partial cross sectional view of the release device in FIG. 5, viewed from another angle.

Referring to FIGS. 4 to 6, the extension rod assembly the present invention comprises an elongate body 1 having a polygonal end 10 at a first end thereof and an engaging end at a second end of the body 1. The polygonal end 10 in this embodiment is a rectangular end and the second end of the body 1 may have a polygonal recess (not shown) for being connected with a tool. An axial passage 11 is defined in the first end of the body 1 and a restriction hole 12 is defined in one of sides of the polygonal end 10 of the body 1. The restriction hole 12 communicates with the axial passage 11. A recessed area 13 is defined in an outer periphery of the body 1 and a positioning hole 14 is defined in the recessed area 13. The positioning hole 14 communicates with the axial passage 11.

A control member 2 includes a handle 20 and a shaft 21 which extends from a side of the handle 20. The shaft 21 is rotatably inserted into the positioning hole 14 and the handle 20 is rotatably engaged with the recessed area 13. The control member 2 is rotatable about an axis thereof. A recess 22 is defined radially in the shaft 21 and thereby forming an eccentric part. The recess 22 is located within the axial passage 11.

An operation rod 3 is axially and movably inserted into the axial passage 11 from the first end of the body 1. Inner threads 115 are defined in the axial passage 11 at the first end of the body 1 and an end piece 6 includes outer threads 60 which are threadedly connected with the inner threads 115 so as to seal the axial passage 11 at the first end of the body 1. The end piece 6 includes a slit 61 defined in an outside thereof such that users can rotate the end piece 6 by engaging a hand tool (not shown) with the slit 61 from the first end of the body 1. A spring 4 is biased between a first end of the operation rod 3 and the end piece 6. The operation rod 3 includes a first dent 30 and a second dent 31 which is located adjacent the first dent in axial direction and communicates with the first dent 30. The second dent 31 is deeper than the first dent 30 in radial direction. The first and second dents 30, 31 are movable to be in alignment with the restriction hole 12 respectively. A second end of the operation rod 3 is an insertion end 32 with two flat surfaces, the insertion end 32 is engaged with the recess 22 of the shaft 21 so that the operation rod 3 is not rotatable within the axial passage 11. A bead 5 is movably engaged with the restriction hole 12.

When the bead 5 is engaged with the first dent 30, the bead 5 partially protrudes out from the restriction hole 12 so as to contact against an inside of the socket 9 that is mounted to the first end of the body 1. Therefore, the socket 9 can be securely positioned on the first end of the body 1 as shown in FIGS. 5 and 6.

Figure 7:
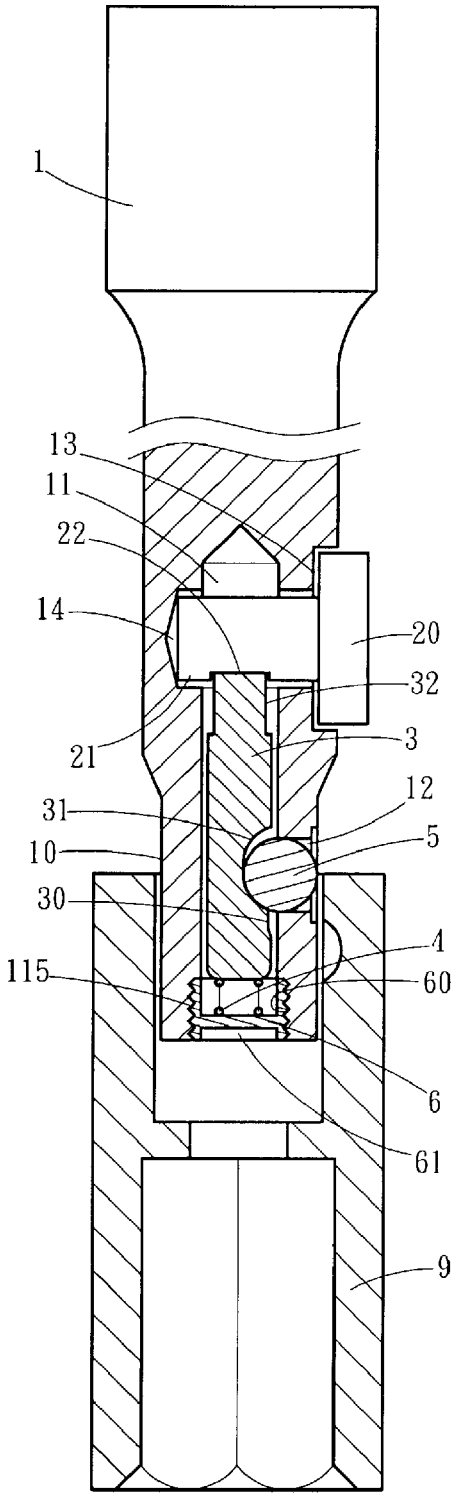
FIG. 7 is a partial cross sectional view to show that the control member is rotated and the bead is merged into the body and the socket can be removed from the body.
Figure 8:
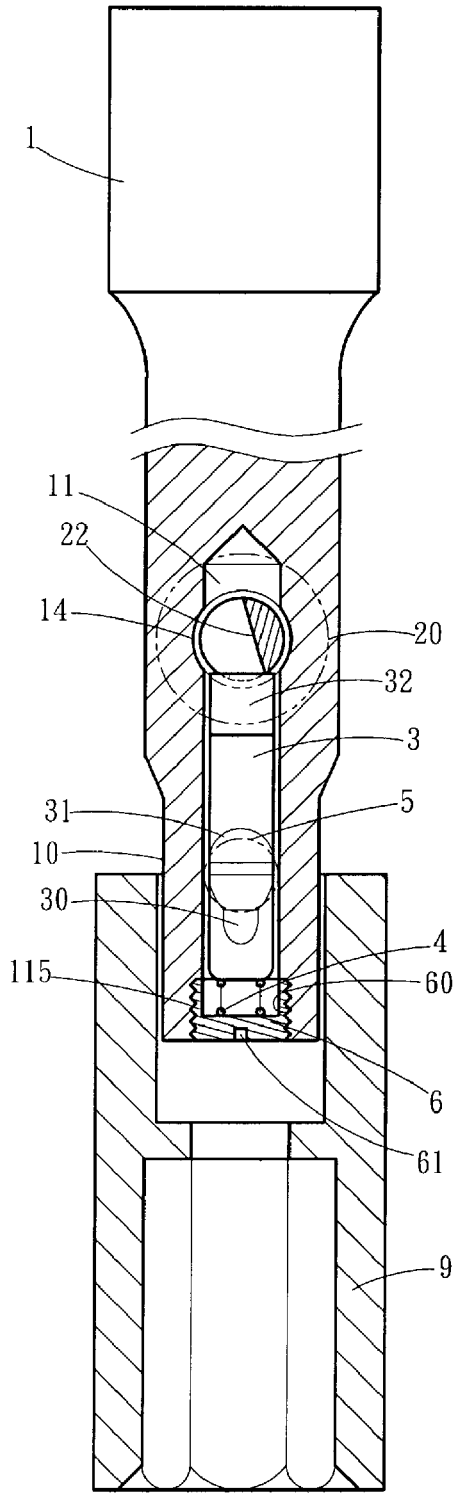
FIG. 8 shows a partial cross sectional view of the release device in FIG. 7, viewed from another angle.

Referring to FIGS. 7 and 8, when releasing the socket 9 from the body 1, the user simply rotates the handle 20 about its own axis, the second end of the operation rod 3 is driven axially by the eccentric part so that the operation rod 3 is moved and the first dent 30 is moved away from the bead 5 which is then engaged with the second dent 31 which is deeper than the first dent 30. The bead 5 is completely merged into the restriction hole 12 and does not contact the socket 9. The socket 9 can easily removed from the body 1. Preferably, the diameter of the shaft 21 of the control member 2 is not less than a diameter of the operation rod 3.

Figure 9:
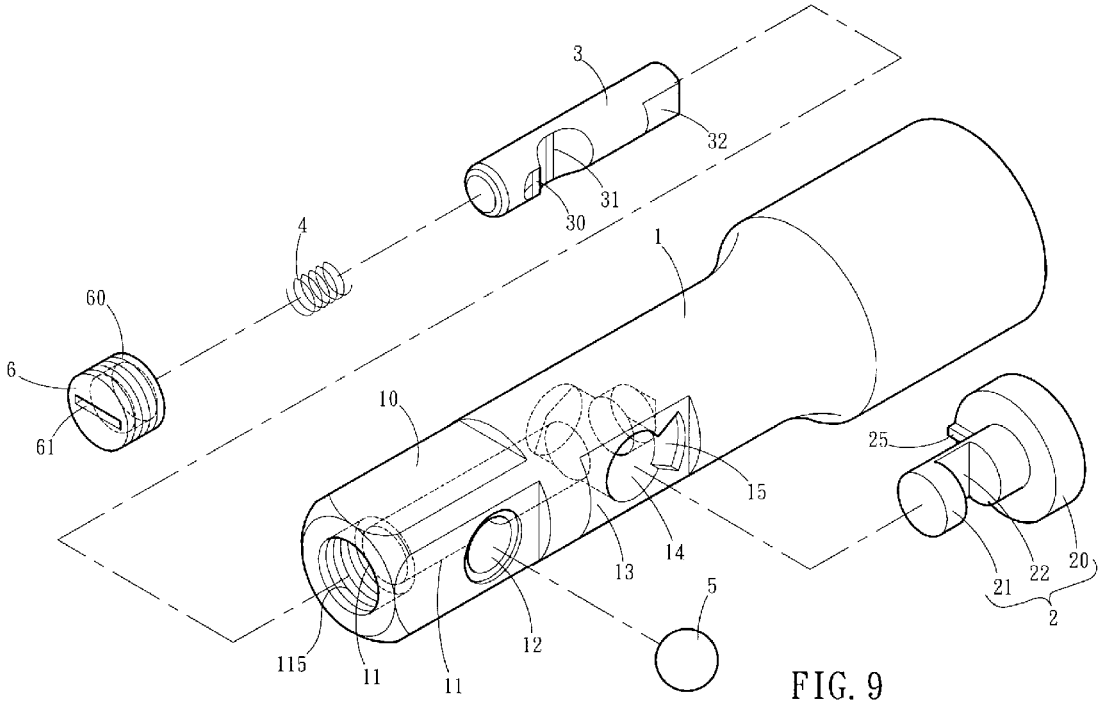
FIG. 9 is an exploded view to show another embodiment of the release device of extension rod assembly of the present invention.

FIG. 9 shows another embodiment of the release device of extension rod assembly of the present invention, wherein an extension 25 extends radially from the shaft 21 and a slot 15 is defined in the body 1 and communicates with the positioning hole 14. The extension 25 is movable between two insides of the slot 15 when operation so as to limit the angle that the control member 2 rotates. The two insides of the slot 15 are two inclined insides and the extension 25 is an elongate extension which moves within an angular range between the two inclined insides of the slot 15.

Figure 10:
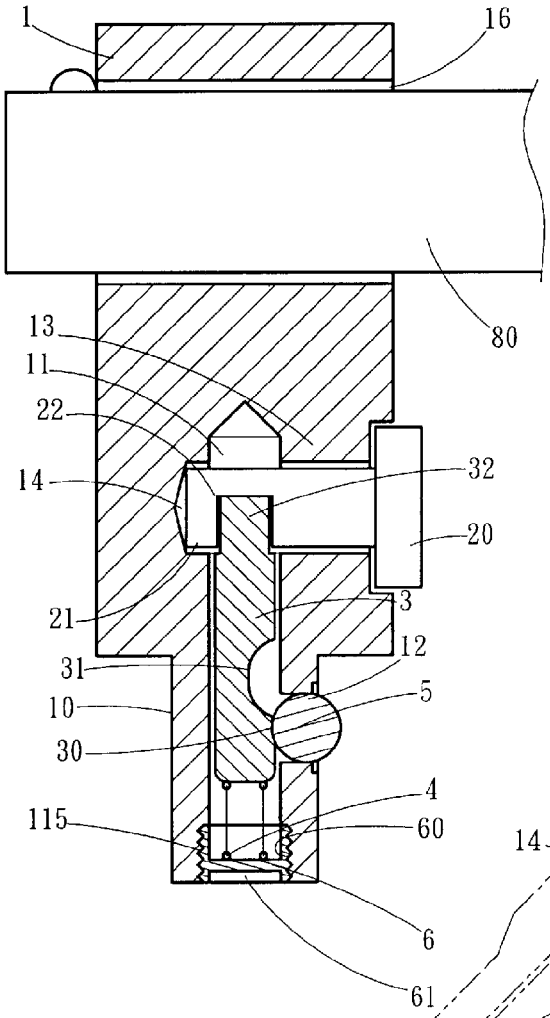
FIG. 10 is a cross sectional view to show that the body includes a transverse passage through which a driving rod extends.

FIG. 10 show another application of the extension rod assembly wherein the body 1 includes a transverse passage 16 through which a driving rod 80 extends. The user can rotate the driving rod to apply a larger torque to the body 1.

Figure 11:
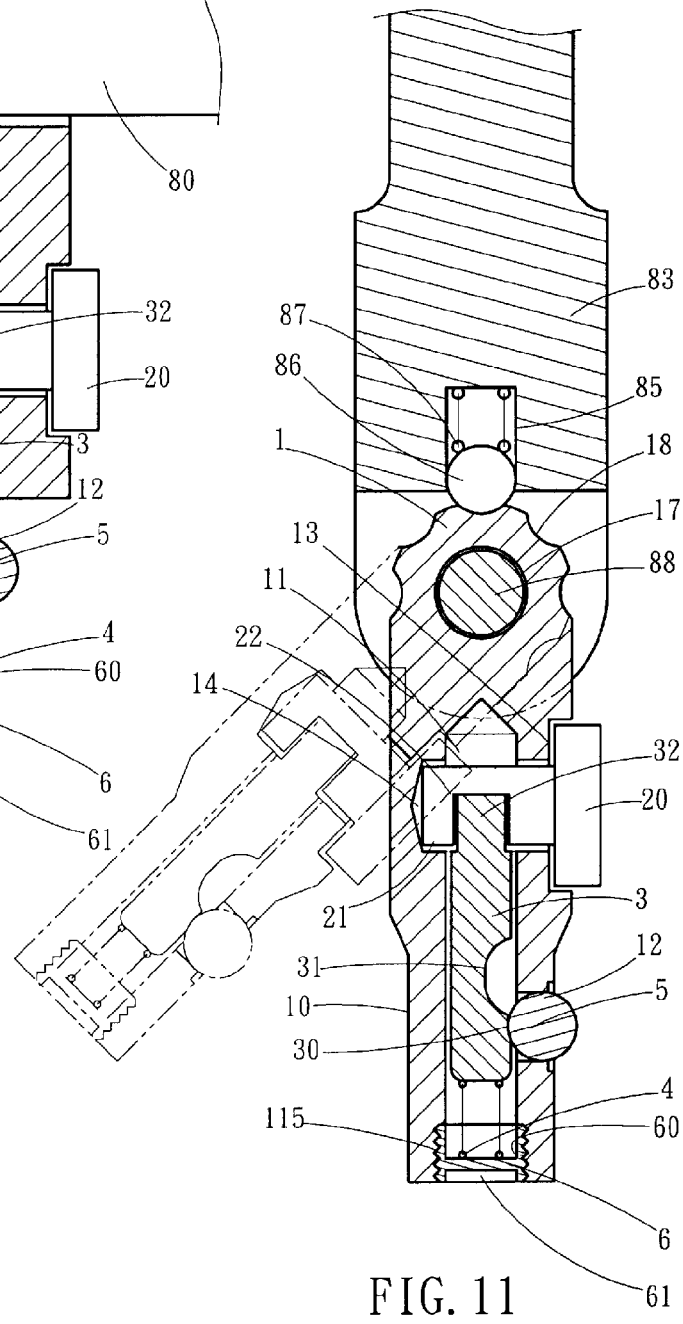
FIG. 11 is a cross sectional view to show that the body is pivotably connected to a shank of a tool.

FIG. 11 show yet another application of the extension rod assembly wherein the second end of the body 1 includes multiple positioning notches 18 defined along a substantially semi-circle end and the second end of the body 1 is pivotably connected to a hand tool 83 by extending a pin 88 through pin holes of two lugs (not shown) of the hand tool 83 and a pivotal hole 17 in the second end of the body 1. An axial recess 85 is defined in the hand tool 83 and a spring 87 and a bead 86 are received in the axial recess 85. The bead 86 is biased by the spring 87 and engaged with one of the positioning notches 18 in the second end of the body 1, such that the body 1 is positioned at an angular position relative to the axis of the hand tool 83.

While we have shown and described the embodiment in accordance with the present invention, it should be clear to those skilled in the art that further embodiments may be made without departing from the scope of the present invention.

What is claimed is:

1. An extension rod assembly, comprising:

a body having a polygonal end at a first end thereof and an engaging end at a second end of the body, an axial passage defined in the first end of the body and a restriction hole defined in one of sides of the polygonal end of the body, the restriction hole communicating with the axial passage, an end piece sealing the axial passage at the first end of the body, a recessed area defined in an outer periphery of the body and a positioning hole defined in the recessed area, the positioning hole communicating with the axial passage;

a control member having a handle and a shaft which extends from a side of the handle, the shaft rotatably inserted into the positioning hole and the handle rotatably engaged with the recessed area, the control member being rotatable about an axis thereof, a recess defined radially in the shaft and forming an eccentric part relative to the shaft, the recess located within the axial passage;

an operation rod axially and movably inserted into the axial passage from the first end of the body and a spring being biased between a first end of the operation rod and the end piece, the operation rod including a first dent and a second dent which is located adjacent the first dent in axial direction and communicates with the first dent, the second dent being deeper than the first dent in radial direction, the first and second dents being movable to be in alignment with the restriction hole respectively, a second end of the operation rod engaged with the recess in the shaft, and a bead movably engaged with the restriction hole and the second end of the operation rod being driven axially by the eccentric part when rotating the shaft so that the bead partially protrudes out from the restriction hole when the bead is engaged with the first dent, the and the bead being merged into the restriction hole when the bead is engaged with the second dent.

2. The assembly as claimed in claim 1, wherein a diameter of the shaft of the control member is not less than a diameter of the operation rod.

3. The assembly as claimed in claim 2, wherein the second end of the operation rod is an insertion end with two flat surfaces, the insertion end is engaged with the recess of the shaft so that the operation rod is not rotatable within the axial passage.

4. The assembly as claimed in claim 3, wherein inner threads are defined in the axial passage at the first end of the body and the end piece includes outer threads which are threadedly connected with the inner threads.

5. The assembly as claimed in claim 4, wherein the end piece includes a slit defined in an outside thereof and is accessible from the first end of the body.

6. The assembly as claimed in claim 3, wherein an extension extends radially from the shaft and a slot is defined in the body and communicates with the positioning hole, the extension is movable between two insides of the slot.

7. The assembly as claimed in claim 6, wherein the two insides of the slot are two inclined insides and the extension is an elongate extension which moves within an angular range between the two inclined insides of the slot.

8. The assembly as claimed in claim 1, wherein the second end of the body includes multiple positioning notches defined along a substantially semi-circle end.

* * * * *